US008215107B2

(12) United States Patent
Pfaff et al.

(10) Patent No.: US 8,215,107 B2
(45) Date of Patent: Jul. 10, 2012

(54) FLOW SUMMATION SYSTEM FOR CONTROLLING A VARIABLE DISPLACEMENT HYDRAULIC PUMP

(75) Inventors: Joseph L. Pfaff, Wauwatosa, WI (US); Eric P. Hamkins, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 104 days.

(21) Appl. No.: 12/901,058

(22) Filed: Oct. 8, 2010

(65) Prior Publication Data

US 2012/0085440 A1 Apr. 12, 2012

(51) Int. Cl.
*F15B 11/00* (2006.01)
*F15B 11/16* (2006.01)

(52) U.S. Cl. ..... 60/424; 60/484

(58) Field of Classification Search ..... 60/422, 60/424, 468, 484
See application file for complete search history.

(56) References Cited

U.S. PATENT DOCUMENTS 5,319,933 A 6/1994 Omberg et al.
5,579,642 A 12/1996 Wilke et al.
5,699,665 A * 12/1997 Coolidge ..... 60/426
5,937,645 A 8/1999 Hamamoto
5,950,429 A 9/1999 Hamkins
6,318,079 B1 11/2001 Barber
6,708,490 B2 * 3/2004 Toji et al. ..... 60/421
6,976,357 B1 12/2005 Pfaff
7,222,484 B1 * 5/2007 Dornbach ..... 60/422
7,275,370 B2 10/2007 Hesse et al.
7,921,878 B2 * 4/2011 Coolidge ..... 137/625.68

* cited by examiner

*Primary Examiner* — Thomas E Lazo
(74) *Attorney, Agent, or Firm* — Quarles & Brady LLP; George E. Haas

(57) ABSTRACT

A valve assembly couples a plurality of hydraulic actuators to a variable displacement pump and to a tank. A separate valve is associated with each hydraulic actuator and comprises a variable flow source orifice between the supply conduit and a summation node coupled to a pump control port, a variable metering orifice between the summation node and the associated hydraulic actuator, and a variable bypass orifice between the summation node and the tank. As a valve operates to enlarge the metering orifice, the flow source orifice also enlarges, and the bypass orifice shrinks. When the valve operates to shrink the metering orifice, the flow source orifice also shrinks and the bypass orifice enlarges. Those operations vary fluid flow in and out of the summation node, which alters pressure applied to the pump control, thereby causing the pump output to vary as required to drive the associated hydraulic actuator.

24 Claims, 2 Drawing Sheets

FLOW SUMMATION SYSTEM FOR CONTROLLING A VARIABLE DISPLACEMENT HYDRAULIC PUMP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to valve assemblies for operating hydraulically powered machinery; and more particularly to such valve assemblies that produce a pressure signal which controls a variable displacement hydraulic pump.

2. Description of the Related Art

The speed of a hydraulically driven working member on a machine depends upon the cross-sectional area of principal narrowed orifices of the hydraulic system and the pressure drop across those orifices. To facilitate control, pressure compensating hydraulic control systems have been designed to eliminate the pressure drop. These previous control systems include load sense conduits which transmit the pressure at the valve workports to the input of a variable displacement hydraulic pump supplying pressurized hydraulic fluid in the system. The resulting self adjustment of the pump output provides an approximately constant pressure drop across a control orifice whose cross-sectional area can be controlled by the machine operator. This facilitates control because, with the pressure drop held constant, the speed of movement of the working member is determined only by the cross-sectional area of the orifice.

One such system is disclosed in U.S. Pat. No. 5,715,865 entitled "Pressure Compensating Hydraulic Control Valve System" in which a separate valve section controls the flow of hydraulic fluid from the pump to each hydraulic actuator that drive a working member. The valve sections are of a type in which the greatest load pressure acting on the hydraulic actuators is sensed to provide a load sense pressure which is transmitted to the control input port of the pump. The greatest load pressure is determined by daisy chain of shuttle valves that receives the load pressure from all the valve sections.

Each valve section includes a control valve, with a variable metering orifice, and a separate pressure compensating valve. The output pressure from the pump is applied to one side of the metering orifice and the pressure compensating valve at the other side of the metering orifice, responds to the load sense pressure, so that the pressure drop across the metering orifice is held substantially constant.

While this system is effective, it requires a separate pressure compensating valve and a shuttle valve in each valve section, in addition to the control valve that has the metering orifice. These additional components add cost and complexity to the hydraulic system, which can be a important consideration for less expensive machines. Thus, there is need for a less expensive and less complex technique for performing this function.

SUMMARY OF THE INVENTION

A control valve assembly is provided for a hydraulic system in which fluid from a variable displacement pump is furnished into a supply conduit for operating a plurality of hydraulic actuators. Fluid from the plurality of hydraulic actuators enters a return conduit through which that fluid flows to a tank.

The control valve assembly includes a flow summation node and a plurality of control valves. The flow summation node is connected to a control input port of the variable displacement pump. Each of the plurality of control valves is operatively connected so that as it opens, fluid flow from the variable displacement pump to the flow summation node increases, fluid from the flow summation node to a respective one of the plurality of hydraulic actuators increases, and fluid flow from the flow summation node to the return conduit decreases. This operation varies pressure applied to the control input port of the variable displacement pump, which responds by increasing the fluid furnished into the supply conduit, in order to satisfy an increased fluid demand for operating the respective hydraulic actuator.

In one aspect of the present invention, each control valve further comprises a variable flow path through which fluid flows from the associated hydraulic actuator to the return conduit.

In another aspect of the present invention, each control valve comprises (1) a variable flow source orifice connected between the variable displacement pump and the flow summation node, (2) a metering orifice connected between the flow summation node and the associated hydraulic actuator for varying the flow of fluid there between, and (3) a variable bypass orifice connected between the flow summation node and the return conduit. Wherein for a given control valve, as the metering orifice enlarges, the variable flow source orifice also enlarges and the variable bypass orifice shrinks; and as the metering orifice shrinks, the variable flow source orifice also shrinks and the variable bypass orifice enlarges in that one valve.

DETAILED DESCRIPTION OF THE INVENTION

The term "directly connected" as used herein means that the associated components are connected together by a conduit without any intervening element, such as a valve, an orifice or other device, which restricts or controls the flow of fluid beyond the inherent restriction of any conduit. If a component is described as being "directly connected" between two points or elements, that component is directly connected to each such point or element.

Figure 1:
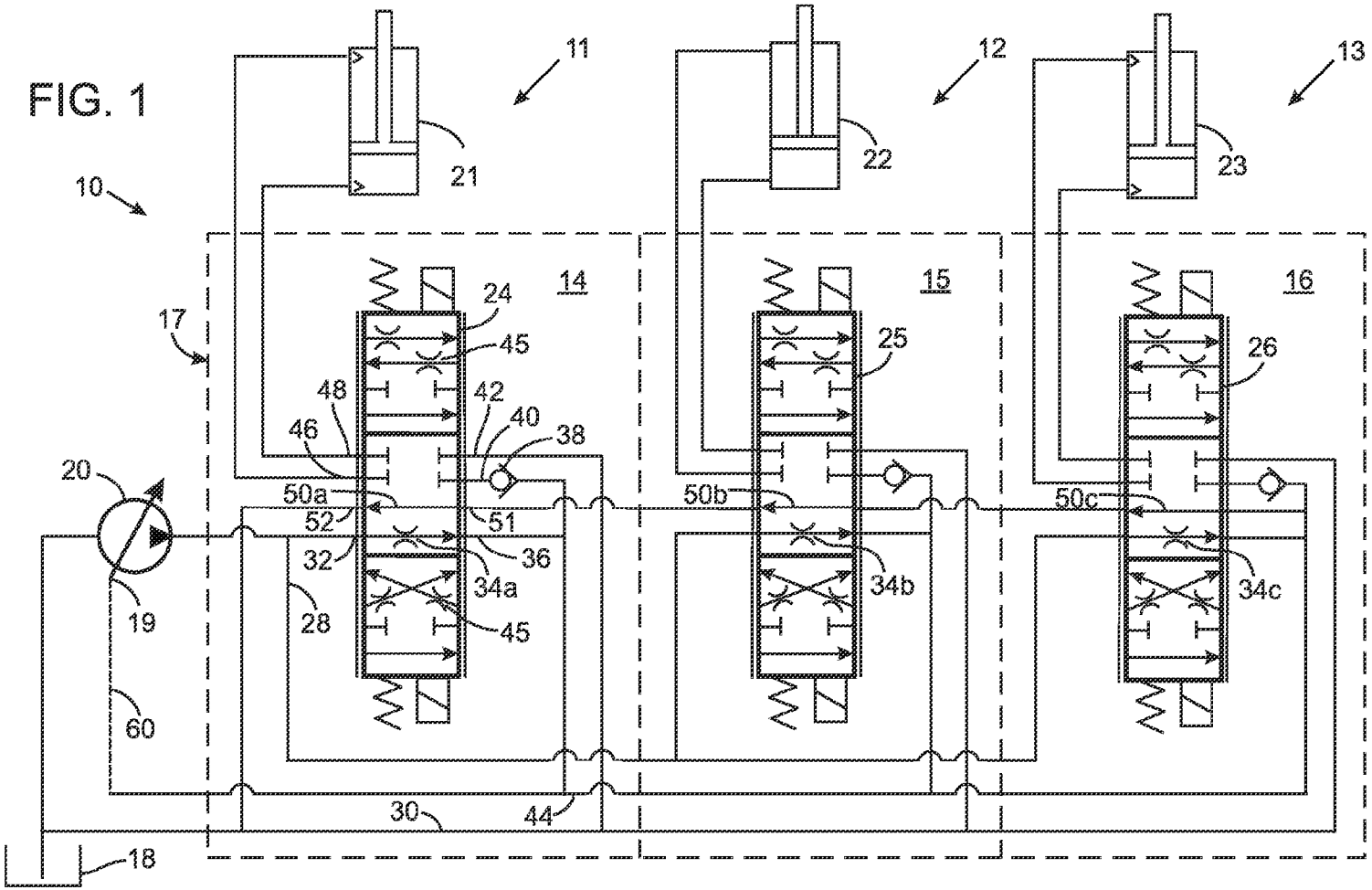
FIG. 1 is a diagram of a hydraulic system that incorporates the present invention.

With initial reference to FIG. 1, a hydraulic system 10 has three hydraulic functions 11, 12 and 13, although a greater or lesser number of hydraulic functions may be used in other hydraulic systems that practice the present invention. Each hydraulic function 11, 12 and 13 respectively comprises a valve unit 14, 15 or 16 and a hydraulic actuator 21, 22 or 23, such as a piston-cylinder arrangement, however, other types of actuators can be used. The three valve units 14, 15 and 16 combine to form a control valve assembly 17. The valve units may be in physically separate assemblies or in a single monolithic assembly. The first valve unit 14 has a first control valve 24, the second valve unit 15 has a second control valve 25, and the third valve unit 16 has a third control valve 26. Each control valve 24, 25 and 26 controls the flow of fluid between the associated hydraulic actuator 21, 22 or 23 and both a variable-displacement pump 20 and a tank 18. The pump 20 furnishes pressurized fluid to a supply conduit 28 and is of a type such that the output pressure is equal to a pressure applied to a control input port 19 plus a fixed predefined amount referred to as the "pump margin". The pump 20 increases or decreases its displacement in order to maintain the "pump margin". As an example, if the difference between the outlet pressure and control input port pressure is less than the pump margin, the pump will increase the displacement. If the difference between the outlet pressure and control input port pressure is greater than the pump margin, then pump displacement is reduced. It is commonly known that flow through an orifice can be represented as being proportional to the flow area and the square root of differential pressure. Since this pump control method provides a constant differential pressure of "pump margin", the flow out of the pump 20 will be linearly proportional to the flow area between the pump outlet and control input port 19. Fluid also flows into the tank 18 through a return conduit 30. The supply conduit 28 and return conduit 30 extend to each of the valve units 14-16.

Each of the control valves 24, 25 and 26 is an open-center, three-position, valve and may be a spool type valve, for example. Although in the exemplary hydraulic system 10, the control valves 24-26 are indicated as being solenoid operated, one or more of them could be operated by a pilot pressure or a mechanical lever or linkage.

The first control valve 24 will be described in detail with the understanding that the description applies to the other two control valves 25 and 26 as well. The first control valve 24 has a supply port 32 that is connected to the supply conduit 28 from the pump 20. A variable flow source orifice 34 within the control valve provides fluid communication between the supply port 32 and a flow outlet 36. To facilitate understanding a subsequent operational description of the hydraulic system 10, the variable flow source orifices for each of the control valves 24, 25 and 26 are identified with numerals 34*a*, 34*b* and 34*c*, respectively. The flow outlet 36 of the first control valve is directly connected to a conduit that is connected to the flow outlet in all the valve units 14-16 and forms a flow summation node 44. Thus, each variable flow source orifice 34*a, b*, and *c* within a control valve is directly connected between the supply conduit 28 and the flow summation node 44 and provides a separate variable fluid path there between.

The flow outlet 36 is connected by a conventional load check valve 38 to a metering orifice inlet 40 of the control valve, so that fluid cannot flow from the metering orifice inlet back into the supply conduit when a large load acts on the associated hydraulic actuator 21. A variable metering orifice 45 within the first control valve 24 connects the flow outlet 36 to one of two workports 46 and 48 depending upon the direction that the first control valve is moved from the center, neutral position. The two workports 46 and 48 connect to different ports on the first hydraulic actuator 21 in the respective first hydraulic function 11. The control valve 24 is normally biased into the center position in which both workports 46 and 48 are closed.

The first control valve 24 also has a bypass orifice 50*a* that is directly connected between a bypass inlet 51 and a bypass outlet 52 of that control valve. The bypass orifices for each of the other control valves 25 and 26 are identified by numerals 50*b* and 50*c*, respectively. The bypass orifices 50*a*, 50*b* and 50*c* are connected in series to provide fluid communication between the summation node 44 and the return conduit 30. Specifically for the exemplary hydraulic system 10, the bypass inlet 51 of the third control valve 26 is directly connected to the summation node 44. The bypass outlet 52 of that control valve 26 is directly connected to the bypass inlet 51 of the second control valve 25 whose bypass outlet is directly connected to the bypass inlet 51 of the first control valve 24. The bypass outlet 52 of the first control valve 24 is connected directly to the return conduit 30. Thus the series of the bypass orifices 50*a*, 50*b* and 50*c* is directly connected between the summation node 44 and the return conduit 30.

Figure 2:
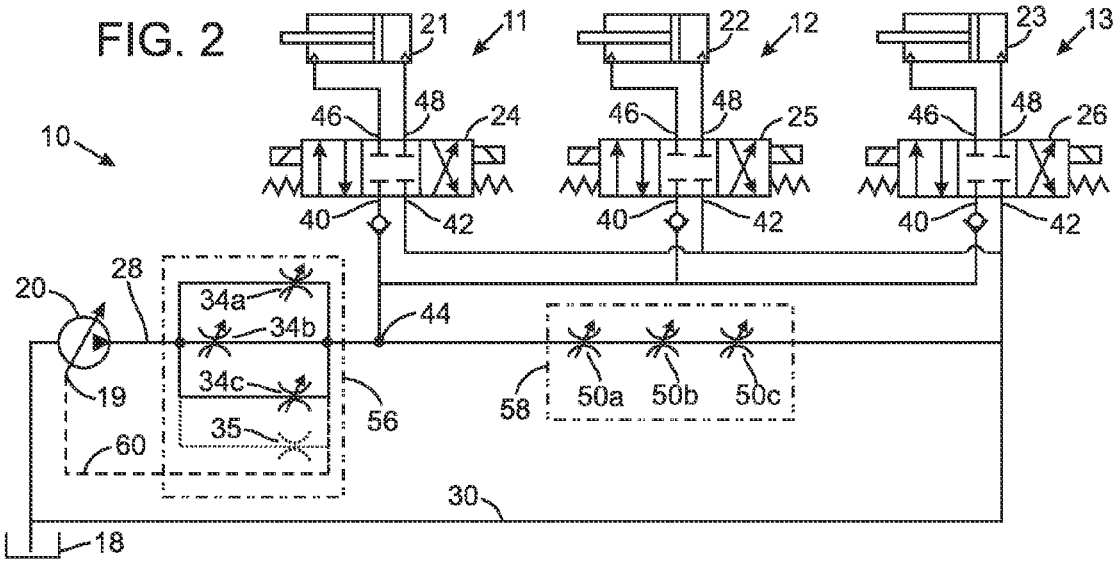
FIG. 2 is a schematic diagram of the hydraulic system in FIG. 1 with certain internal components separated from the control valves and rearranged for a better understanding of their functional relationships.

FIG. 2 is a schematic diagram of the hydraulic system 10 in which the variable flow source orifices 34*a, b* and *c* and the bypass orifices 50*a, b* and *c* are arranged in more functional groupings with those respective orifices shown outside the corresponding control valve 24, 25 and 26 in which they are actually located. This functional diagram shows that the three variable flow source orifices 34*a, b* and *c* are connected in parallel directly between the supply conduit 28 from the pump 20 and the flow summation node 44. This parallel connection forms a variable flow section 56. The three bypass orifices 50*a, b* and *c* are connected in series between the flow summation node 44 and the return conduit 30 to the tank 18 and form a bypass section 58 of the hydraulic system 10.

Assume initially that all the control valves 24-26 are in the center position in which both workports 46 and 48 are closed. In that state, the output from the pump 20, applied to supply conduit 28, passes through the variable flow source orifices 34*a-c*, which are all now shrunk to a relatively small flow areas. Therefore, a relatively small amount of fluid flows from the pump 20 through the variable flow section 56 to the summation node 44. At this time, all the bypass orifices 50*a-c* in the bypass section 58 are enlarged to provide relatively large flow areas, thereby allowing the fluid entering the summation node 44 to pass easily into the return conduit 30. As a consequence, the pressure at the fluid summation node 44 is at a relatively low level, that is transmitted through a pump control conduit 60 to the control input port 19 of the variable displacement pump 20.

Alternatively when a control valve 24, 25 or 26 is in the center position, its variable flow source orifice 34*a, b* or *c* can be fully closed so that no fluid flows through that control valve between the supply conduit 28 and the flow summation node 44. In this version of the system, a separate small, fixed orifice 35 may be added to connect the supply conduit 28 to the flow summation node 44 in the variable flow section 56, so that some flow from the supply conduit enters the flow summation node when all the control valves are in the center position.

Operation of the present control technique will be described in respect of the first hydraulic function 11 with the understanding that the other hydraulic functions 12 and 13 operate in the same manner. The opening movement of the first control valve 24 in either direction from the center position connects the metering orifice inlet 40 through the variable metering orifice 45 to one of the workports 46 or 48, depending upon the direction of that motion. Opening the first control valve 24 also connects the other workport 48 or 46 to the outlet port 42 that leads to the return conduit 30. At the same time, the variable flow source orifice 34*a* enlarges by an amount related to the distance that the control valve moves, thereby causing the pump to increase fluid flow from the supply conduit 28 to the flow summation node 44 in order to maintain the "pump margin," as previously described. Simultaneously, the size of the bypass orifice 50*a* shrinks, causing pressure at the summation node 44 to increase. Thus as the first control valve 24 opens a path through which fluid is supplied to the first hydraulic actuator 21, the flow through the variable flow section 56 into the summation node 44 increases, while the restriction, created by bypass orifice 50*a*, to flow occurring out of that node to the tank return conduit 30 also increases thereby causing the pressure at the flow summation node 44 to increase.

When the flow summation node pressure is sufficiently great to overcome the load force acting on the first actuator 21, fluid begins to flow through the metering orifice 45 in the first control valve 24 to drive the first actuator.

At the same time that the first control valve 24 is opening one or more of the other control valves 25 or 26 also may be open. Their respective variable flow source orifices 34*b* and 34*c* also will be conveying fluid from the supply conduit 28 into the flow summation node 44. Because the three variable flow source orifices 34*a*-34*c* are connected in parallel, the same pressure differential is across each of those orifices. That pressure differential and the cross sectional area of each flow source orifice determines the amount of flow through that orifice. The total flow into the flow summation node is the aggregate of the individual flows through each variable flow source orifice 34*a*-34*c*. As a result, the sum of the areas that each variable flow source orifice is open determines the aggregate flow into the flow summation node 44 and thus controls the output flow from the variable displacement pump 20. The respective flow area of the metering orifice 45 in each control valve 24, 25, 26 and the respective load forces on actuators 21, 22, and 23 determine the amount of flow each actuator receives from the flow summation node 44.

When the first hydraulic actuator 21 reaches the desired position, the first control valve 24 is returned to the center position by whatever apparatus controls that valve. In the center position, the two workports are closed again cutting off fluid flow from the flow summation node 44 to the first hydraulic actuator 21. In addition, the variable flow source orifice 34*a* shrinks to a relatively small size which reduces the flow from the supply conduit 28 to the flow summation node 44. Returning the first control valve 24 to the center position also enlarges the size of the bypass orifice 50*a*. Now if the other control valves 25 and 26 also are in the center position, all their bypass orifice 50*a*-*c* are relatively large thereby relieving the flow summation node pressure into the return conduit 30.

Alternatively, a single relatively small fixed orifice could be employed in place of a variable bypass orifice 50*a*-*c* in each valve unit 11-13. The size of that single fixed bypass orifice would be selected so as not to appreciably affect the pressure buildup at the flow summation node as one or more control valve 24, 25 or 26 opens, but still release the pressure at that node when all the control valves are closed.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A control valve assembly for a hydraulic system in which fluid from a variable displacement pump is furnished into a supply conduit for operating a plurality of hydraulic actuators and in which fluid from the plurality of hydraulic actuators enters a return conduit, said control valve assembly comprising:

a flow summation node in fluid communication with a control input port of the variable displacement pump; and a plurality of valve units, each associated with one of the plurality of hydraulic actuators and comprising a metering orifice connected between the flow summation node and the associated hydraulic actuator for varying the flow of fluid there between and a variable flow source orifice;

wherein the variable flow source orifices of the plurality of valve units are connected in parallel between the variable displacement pump and the flow summation node.

2. The control valve assembly as recited in claim 1 wherein in each of the plurality of valve units, as the metering orifice enlarges, the variable flow source orifice also enlarges, and as the metering orifice shrinks, the variable flow source orifice also shrinks.

3. The control valve assembly as recited in claim 2 wherein each of the plurality of valve units further comprises a variable bypass orifice connected between the flow summation node and the return conduit, wherein the variable bypass orifice shrinks as the metering orifice enlarges and the variable bypass orifice enlarges as the metering orifice shrinks.

4. The control valve assembly as recited in claim 1 wherein each of the plurality of valve units further comprises a variable bypass orifice connected between the flow summation node and the return conduit.

5. The control valve assembly as recited in claim 4 wherein the variable bypass orifices in the plurality of valve units are connected in series between the flow summation node and the return conduit.

6. The control valve assembly as recited in claim 4 wherein in each valve unit, the variable flow source orifice, the metering orifice, and the variable bypass orifice are integrated into a single control valve.

7. The control valve assembly as recited in claim 6 wherein the control valve is a spool valve.

8. The control valve assembly as recited in claim 4 wherein the control valve comprises a first workport to which one of the plurality of hydraulic actuators is connected; and wherein the control valve has:

a) a first position in which the first workport is closed, the variable flow source orifice has a first size, and the variable bypass orifice has a second size, and b) a second position in which the first workport is coupled by the metering orifice to the flow summation node, the variable flow source orifice has a third size that is greater than the first size, and the variable bypass orifice has a fourth size that is less than the second size.

9. The control valve assembly as recited in claim 8 wherein the control valve further comprises a second workport to which the one of the plurality of hydraulic actuators is connected; and wherein the control valve has:

c) a third position in which the second workport is coupled by the metering orifice to the flow summation node, the variable flow source orifice has a fifth size that is greater than the first size, and the variable bypass orifice has a sixth size that is less than the second size.

10. The control valve assembly as recited in claim 1 wherein each of the plurality of valve units further comprises a check valve that prevents fluid flow in a direction from the metering orifice into the supply conduit.

11. A control valve assembly for controlling application of fluid from a variable displacement pump to a plurality of hydraulic actuators, wherein fluid also flows from the plurality of hydraulic actuators into a return conduit leading to a tank, said control valve assembly comprising:

a flow summation node in fluid communication with a control input port of the variable displacement pump; and a plurality of control valves operatively connected wherein opening any one of the plurality of control valves controls a path through which fluid flow increases from the variable displacement pump to the flow summation node, provides a fluid path from the flow summation node to a respective one of the plurality of hydraulic actuators, and decreases fluid flow from the flow summation node to the return conduit.

12. The control valve assembly as recited in claim 11 wherein each of the plurality of control valves further comprises a variable flow path through which fluid flows from the respective hydraulic actuator to the return conduit.

13. The control valve assembly as recited in claim 11 wherein each of the plurality of control valves comprises a variable flow source orifice which increases fluid flow from the variable displacement pump to the flow summation node as the valve is opening.

14. The control valve assembly as recited in claim 11 wherein each of the plurality of control valves comprises a variable metering orifice through which flows the fluid applied from the flow summation node to a respective one of the plurality of hydraulic actuators.

15. The control valve assembly as recited in claim 11 wherein each of the plurality of control valves comprises a variable bypass orifice which decreases fluid flow from the flow summation node to the return conduit as the valve is opening.

16. The control valve assembly as recited in claim 11 wherein each of the plurality of control valves comprises:

a variable flow source orifice in fluid communication with both the variable displacement pump and the flow summation node;

a metering orifice in fluid communication with the flow summation node and the respective hydraulic actuator; and a variable bypass orifice in fluid communication with the flow summation node and the return conduit.

17. The control valve assembly as recited in claim 16 wherein each of the plurality of control valves has:

a) a first state in which the first workport is closed, the variable flow source orifice has a first size, and the variable bypass orifice has a second size, and b) a second state in which the respective one of the plurality of hydraulic actuators is coupled by the metering orifice to the flow summation node, the variable flow source orifice has a third size that is greater than the first size, and the variable bypass orifice has a fourth size that is less than the second size.

18. A control valve assembly for a hydraulic system in which fluid from a variable displacement pump is furnished into a supply conduit for operating a hydraulic actuator and in which fluid from the hydraulic actuator enters a return conduit connected to a tank, said control valve assembly comprising:

a flow summation node in fluid communication with a control input port of the variable displacement pump; and a control valve comprising (1) a variable flow source orifice connected between the supply conduit and the flow summation node, (2) a metering orifice connected between the flow summation node and the hydraulic actuator for varying the flow of fluid there between, and (3) a variable bypass orifice connected between the flow summation node and the return conduit;

wherein as the metering orifice enlarges, the variable flow source orifice also enlarges and the variable bypass orifice shrinks; and as the metering orifice shrinks, the variable flow source orifice also shrinks and the variable bypass orifice enlarges.

19. The control valve assembly as recited in claim 18 wherein the control valve is a spool valve.

20. The control valve assembly as recited in claim 18 wherein the control valve comprises a first workport to which the hydraulic actuator is connected; and wherein the control valve has:

a) a first position in which the first workport is closed, the variable flow source orifice has a first size, and the variable bypass orifice has a second size, and b) a second position in which the first workport is coupled by the metering orifice to the flow summation node, the variable flow source orifice has a third size that is greater than the first size, and the variable bypass orifice has a fourth size that is less than the second size.

21. A control valve assembly for a hydraulic system in which fluid is drawn from a tank by a variable displacement pump and then furnished into a supply conduit, and the hydraulic system having a plurality of hydraulic actuators, said control valve assembly comprising:

a flow summation node; and a plurality of valve units, each comprising a variable flow source orifice through which fluid flows between the variable displacement pump and the flow summation node, a variable metering orifice through which fluid flows between the flow summation node and one of the plurality of hydraulic actuators, and a variable bypass orifice through which fluid flows between the flow summation node and the tank, wherein the variable flow source orifice, the metering orifice and the variable bypass orifice being operatively coupled so that as the metering orifice enlarges, the variable flow source orifice enlarges and the variable bypass orifice shrinks, and so that as the metering orifice shrinks, the variable flow source orifice shrinks and the variable bypass orifice enlarges;

wherein the variable flow source orifices of the plurality of valve units are connected in parallel and the variable bypass orifices of the plurality of valve units are connected in series.

22. The control valve assembly as recited in claim 21 wherein the flow summation node is in fluid communication with a control input of the variable displacement pump.

23. The control valve assembly as recited in claim 21 each of the plurality of valve units further comprises a separate check valve operatively connected to inhibit fluid flow through the metering orifice and into the supply conduit.

24. The control valve assembly as recited in claim 21 wherein in each of the plurality of valve units the variable flow source orifice, the metering orifice, and the variable bypass orifice are integrated into a single control valve.

* * * * *